US012326141B2

(12) United States Patent
Deng

(10) Patent No.: US 12,326,141 B2
(45) Date of Patent: Jun. 10, 2025

(54) HIGH-PRESSURE, HIGH-FLOW INFLATABLE MOVEMENT

(71) Applicant: Dongguan Lingdu Industrial Co., Ltd., Dongguan (CN)

(72) Inventor: Yamei Deng, Dongguan (CN)

(73) Assignee: Dongguan Lingdu Industrial Co., Ltd., Dongguan (CN)

( * ) Notice: Subject to any disclaimer, the term of this patent is extended or adjusted under 35 U.S.C. 154(b) by 22 days.

(21) Appl. No.: 18/516,076

(22) Filed: Nov. 21, 2023

(65) Prior Publication Data

US 2024/0167464 A1 May 23, 2024

(30) Foreign Application Priority Data

Nov. 23, 2022 (CN) ..... 202211477085.3

(51) Int. Cl.

| | |
|---|---|
| ***F04B 35/04*** | (2006.01) |
| ***F04B 23/10*** | (2006.01) |
| ***F04B 23/14*** | (2006.01) |
| ***F04B 39/12*** | (2006.01) |
| ***F04B 39/16*** | (2006.01) |
| ***F04B 41/06*** | (2006.01) |

(52) U.S. Cl.

CPC ..... *F04B 35/04* (2013.01); *F04B 23/10* (2013.01); *F04B 23/14* (2013.01); *F04B 39/121* (2013.01); *F04B 39/123* (2013.01); *F04B 39/16* (2013.01); *F04B 41/06* (2013.01)

(58) Field of Classification Search

CPC ..... F04B 39/121; F04B 39/123; F04B 41/06; F04B 23/10; F04B 23/14

See application file for complete search history.

(56) References Cited

U.S. PATENT DOCUMENTS

| | | | | |
|---|---|---|---|---|
| 4,877,378 | A * | 10/1989 | Saggers | F04B 45/047 417/299 |
| 6,623,249 | B1 * | 9/2003 | Rogers | F04B 41/06 417/428 |
| 8,079,824 | B2 * | 12/2011 | Chou | F04B 35/06 417/16 |
| 9,624,924 | B2 * | 4/2017 | Chou | F04B 35/04 |
| 9,759,207 | B2 * | 9/2017 | Chou | F04B 39/127 |
| 10,138,878 | B2 * | 11/2018 | Chou | F04B 39/125 |
| 11,686,299 | B2 * | 6/2023 | Huang | F04B 41/06 60/452 |
| 2023/0323870 | A1 * | 10/2023 | Chen | F04B 37/10 |

FOREIGN PATENT DOCUMENTS

| | | |
|---|---|---|
| CN | 217129717 U | 8/2022 |
| CN | 218760352 U | 3/2023 |
| CN | 218760360 U | 3/2023 |

* cited by examiner

*Primary Examiner* — Christopher S Bobish
(74) *Attorney, Agent, or Firm* — Nitin Kaushik

(57) ABSTRACT

The present disclosure relates to a technical field of inflatable pump movement, specifically to a high-pressure, high-flow inflatable movement. A double air intake communicator communicated with the air supply fan device and the air supply piston device again is adopted, the air supply fan device is used for outputting a high-flow gas to the double air intake communicator, and the air supply piston device is used for outputting a high-pressure gas to the double air intake communicator.

9 Claims, 9 Drawing Sheets

HIGH-PRESSURE, HIGH-FLOW INFLATABLE MOVEMENT

CROSS-REFERENCE TO RELATED APPLICATIONS

The present disclosure claims the priority of a Chinese patent application CN 202211477085.3 with a filing date on Nov. 23, 2022, and its entire content is incorporated by reference into the application.

TECHNICAL FIELD

The present disclosure relates to a technical field of inflatable pump movement, specifically to a high-pressure, high-flow inflatable movement.

BACKGROUND

An inflatable movement is a core component of an air compressor, using a motor to drive the transmission mechanism to continuously compress the gas in the compression cylinder, and then discharge the gas by the valve from the air outlet.

The existing inflatable movement is only inflated by air compression, with low inflation efficiency. When using the inflatable products that need large capacity and high pressure, such as automobile tires and inflatable pulp plates, inflation is time-consuming, and the inflatable movement is easy to be overheated and damaged.

SUMMARY

An object of the present disclosure is to provide a high-pressure, high-flow inflatable movement, comprising a double air intake communicator, an air supply fan device communicated with the first air inlet of the double air intake communicator, an air supply piston device communicated with a second air inlet of the double air intake communicator, a first one-way valve communicated with the double air intake communicator and the air supply fan device, a second one-way valve communicated with the double air intake communicator and the air supply piston device, and an inflatable joint communicated with an air outlet of the double air intake communicator, the air supply fan device is used for outputting a high-flow gas to the double air intake communicator, and the air supply piston device is used for outputting a high-pressure gas to the double air intake communicator.

Preferably, the air supply fan device comprises a fan housing connected with the double air intake communicator and communicated with the first air inlet, and a fan body connected with the fan housing, and one end of the fan housing is provided with a first wind inlet.

Preferably, the air supply fan device further comprises a filter screen connected with an inner wall of the first wind inlet in the fan housing.

Preferably, a top of the fan housing is provided with a first accommodating groove for accommodating the first one-way valve, and a bottom wall of the first accommodating groove is provided with a first wind outlet.

Preferably; the air supply piston device comprises a cylinder-integrated bracket connected with the double air intake communicator and communicated with the second air inlet, a motor connected with a bottom of the cylinder-integrated bracket, a heat dissipation fan in transmission connection with a first output end of the motor, a gear transmission mechanism in transmission connection with other output end of the motor, and a connecting rod piston in transmission connection with the gear transmission mechanism, a piston end of the connecting rod piston is slidably connected with an inner wall of the cylinder end of the cylinder-integrated bracket, and the piston end of the connecting rod piston is provided with a second wind inlet.

Preferably, one end of the double air intake communicator connected with the cylinder-integrated bracket is recessed with a second accommodating groove for accommodating the second one-way valve, and the second air inlet is provided at the bottom wall of the second accommodating groove.

Preferably, the side wall of the double air intake communicator is protruded with a rotating buckle, and one end of the cylinder-integrated bracket connected with the double air intake communicator is provided with a rotating clamping groove for clamping with the rotating buckle.

Preferably, the rotating buckle comprises a rotating bump protruded on the side wall of the double air intake communicator, and a convex ridge protruded on the rotating bump, the rotating clamping groove comprises a relinquishment groove, a notch communicated with the relinquishing groove, and a buckle groove provided on the cylinder-integrated bracket and communicated with a top of the notch, and the relinquishing groove is used for the rotating bump to stretch and screw into the notch, and the convex ridge is clamped with the buckle groove.

Preferably, the double air intake communicator comprises a first casing, and a first inner pipe connected in the first casing and penetrates through the first casing close to one end of the air supply piston device, the first air inlet is provided at the bottom of the first casing, and the second air inlet is provided in one end of the first inner pipe close to the air supply piston device.

Preferably, the inflatable joint comprises a second casing communicated with the first casing, a second inner pipe connected in the second casing and penetrates through the second casing far away from one end of the first casing, one end of the second casing away from the first casing is provided with a high-flow exhaust hole, one end of the second inner pipe away from the first inner pipe is provided with a high-pressure exhaust hole, the air supply fan device, the first casing, the second casing and the high-flow exhaust hole are communicated to form a first channel for transporting the high-flow gas, and the air supply piston device, the first inner pipe, the second inner pipe and the high-pressure exhaust hole are communicated to form a second channel for transporting the high-pressure gas.

Figure 1:
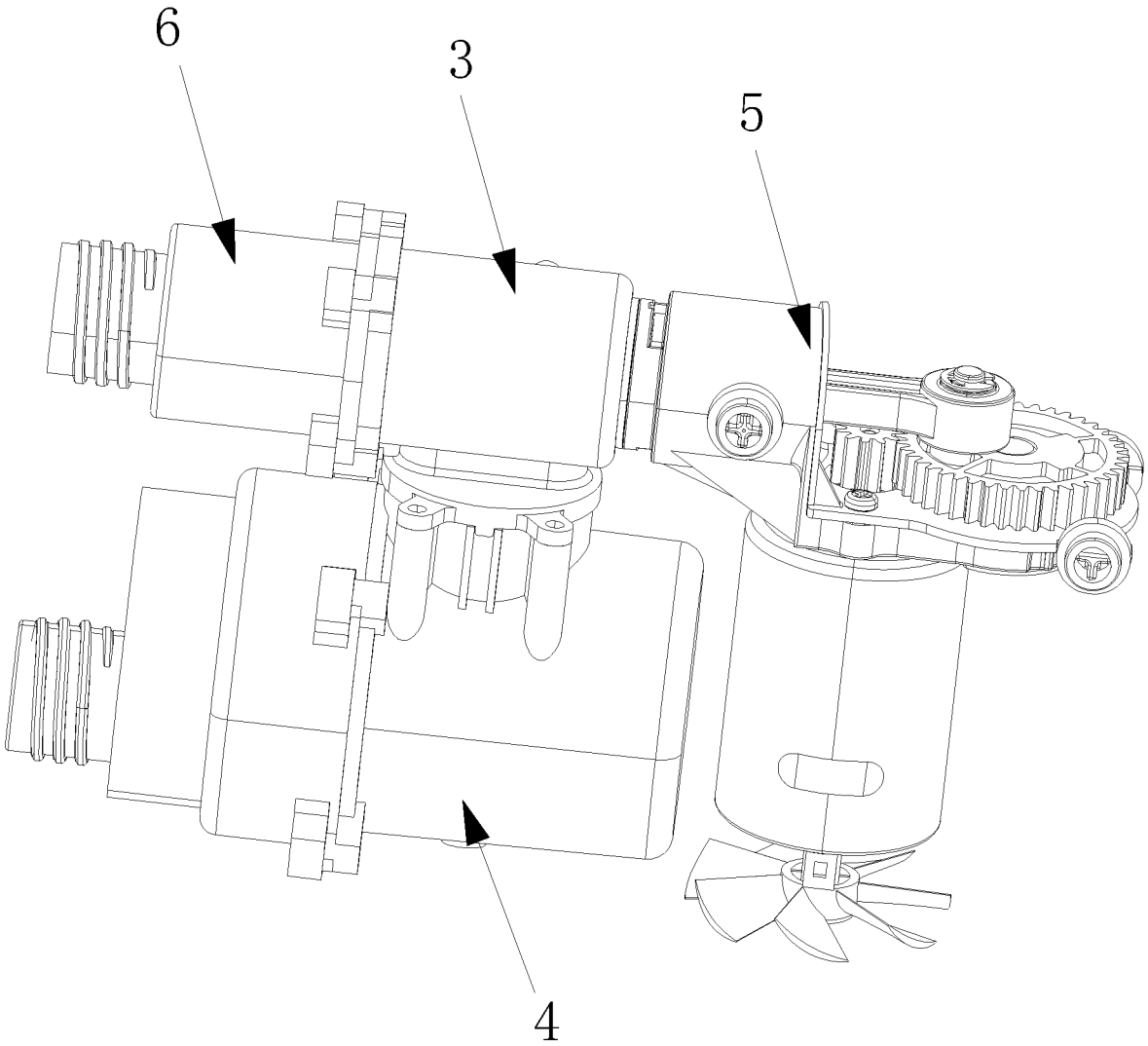
FIG. 1 is a schematic diagram of the structure of the present disclosure.

1. first one-way valve: 2. second one-way valve: 3. double air intake communicator; 31. first casing: 32. first inner tube; 4. air supply fan device: 41. fan housing: 42. fan body: 43. filter screen: 5. air supply piston device: 51. cylinder-integrated bracket: 52. motor; 53. heat dissipation fan: 54. gear transmission mechanism: 55. connecting rod piston; 6. inflatable joint; 61. second casing: 62. second inner tube: 7. first air inlet: 8. second air inlet: 9. first wind inlet; 10. first accommodating groove: 11. first wind outlet; 12. second wind inlet: 13. second accommodating groove: 14. rotating buckle: 141. rotating bump: 142. convex ridge: 15. rotating clamping groove; 151. relinquishing groove: 152. notch: 153. buckle groove: 16. high-flow exhaust hole: 17. high-pressure exhaust hole.

DETAILED DESCRIPTION OF THE EMBODIMENTS

In order to facilitate the understanding of those skilled in the art, the present disclosure is further described below in conjunction with the embodiments and the accompanying drawings, and the content mentioned in the embodiment is not limited the present disclosure.

As shown in FIG. 1-9, a high-pressure, high-flow inflatable movement comprises a double air intake communicator 3, an air supply fan device 4 communicated with a first air inlet 7 of the double air intake communicator 3, an air supply piston device 5 communicated with a second air inlet 8 of the double air intake communicator 3, a first one-way valve 1 communicated with the double air intake communicator 3 and the air supply fan device 4, a second one-way valve 2 communicated with the double air intake communicator 3 and the air supply piston device 5, and an inflatable joint 6 communicated with the air outlet of the double air intake communicator 3, the air supply fan device 4 is used for outputting a high-flow gas to the double air intake communicator 3, and the air supply piston device 5 is used for outputting a high-pressure gas to the double air intake connecting device 3.

The high-pressure, high-flow inflatable movement adopts a double air intake communicator 3 communicated with the air supply fan device 4 and an air supply piston device 5, the air supply fan device 4 is used for outputting a high-flow gas to the double air intake communicator 3, and the air supply piston device 5 is used for outputting a high-pressure gas to the double air intake communicator 3. Using the first one-way valve 1 and the second one-way valve 2, wind interference is prevented. If the inflatable product has a low air pressure, the air supply fan device 4 is turned on to output a high-flow gas to the double air intake communicator 3, and fill a large flow of gas, with an improved gas filling efficiency, and when the inflatable product has a high air pressure and the air filling capacity of the air supply fan device 4 is significantly reduced, the air supply fan device 4 is turned off, and the air supply piston device 5 is turned on to output a high-pressure gas to the double air intake communicator 3, until the expected high pressure is reached, significantly reducing the inflation time, preventing the overheating and damage of the inflatable movement operation.

Figure 2:
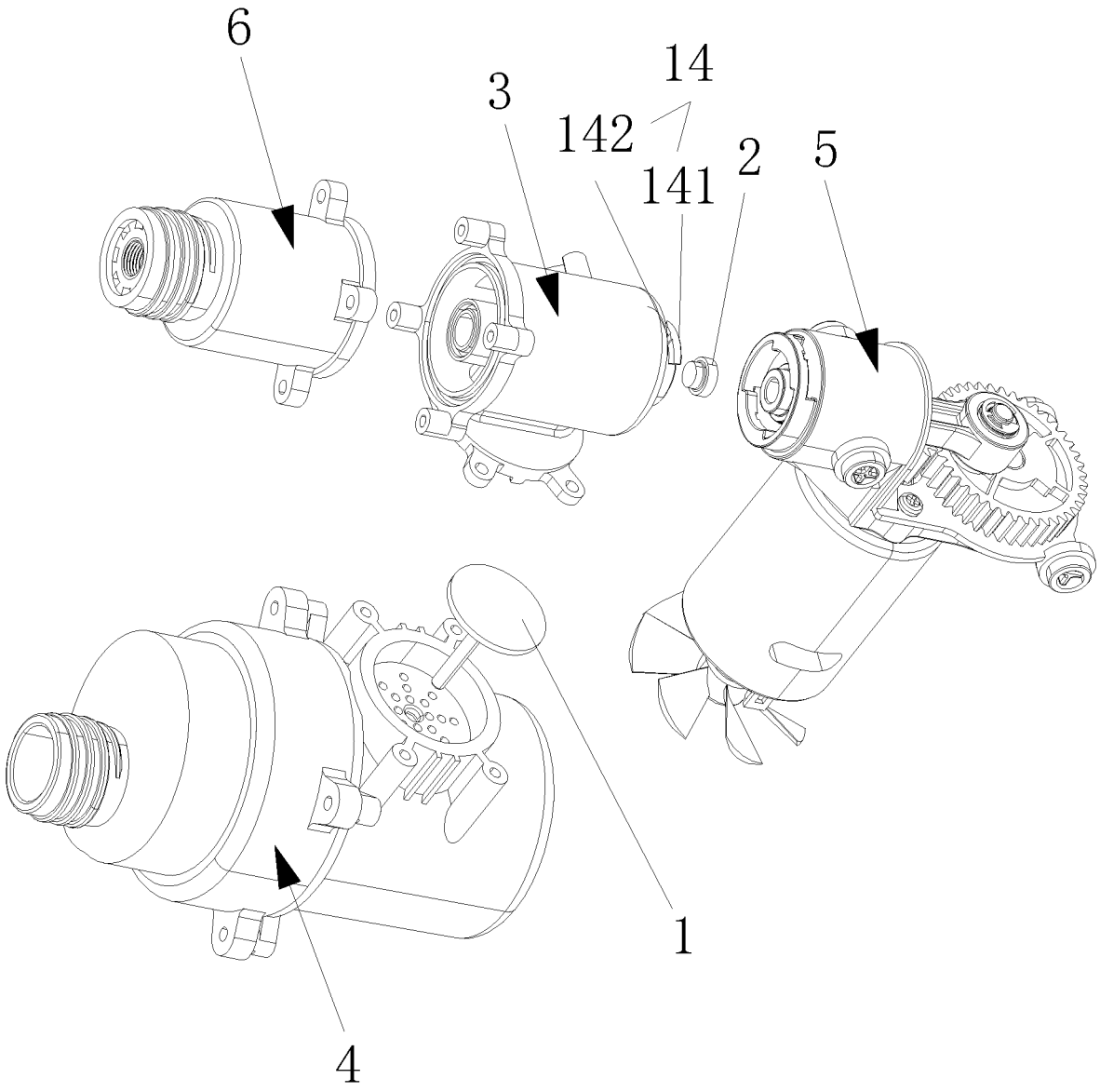
FIG. 2 is a schematic diagram of an exploded structure of one part of the present disclosure.
Figure 3:
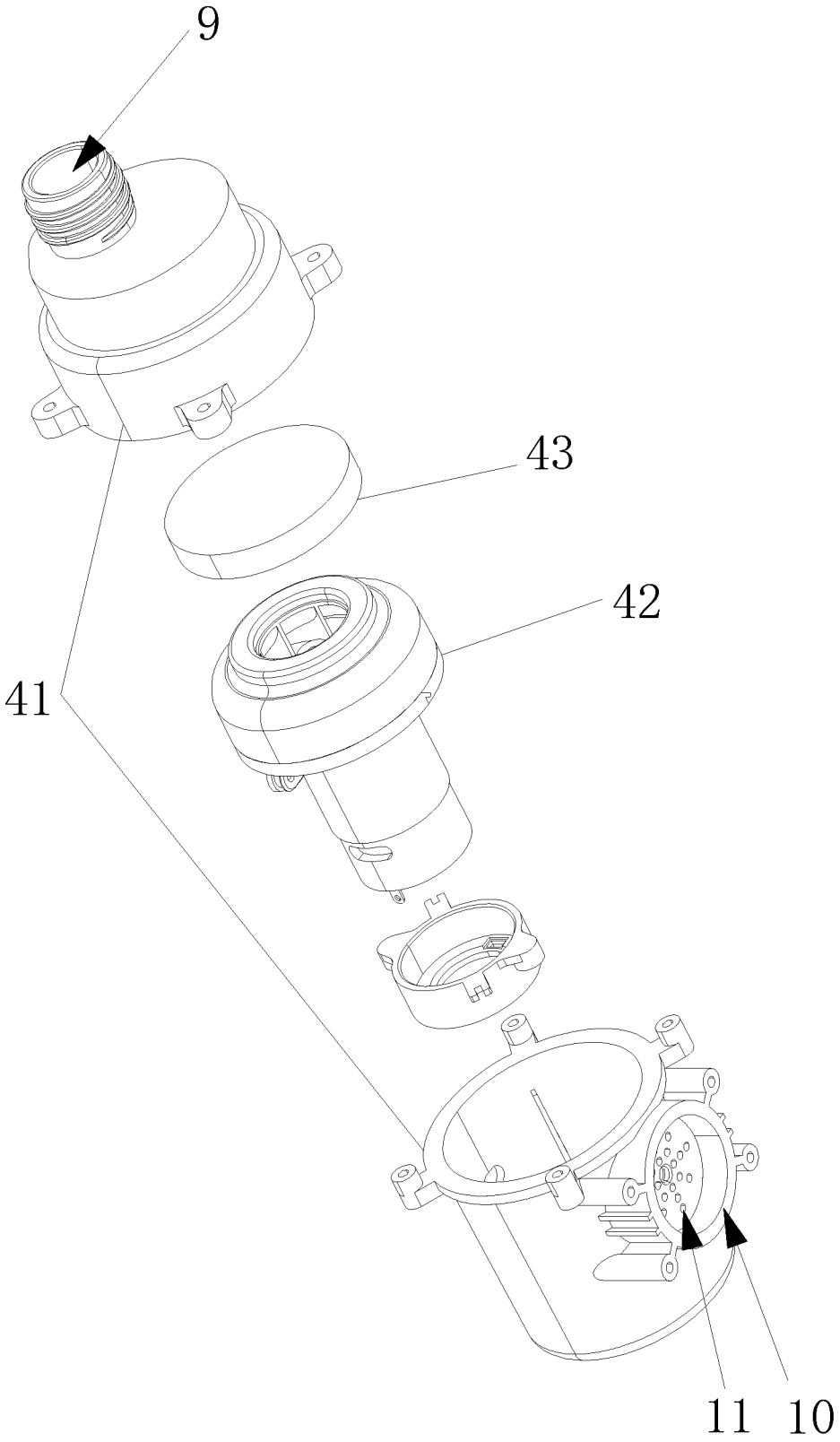
FIG. 3 is a schematic diagram of an exploded structure of the gas supply fan device of the present disclosure.

In the embodiment of FIG. 1-3, the air supply fan device 4 comprises a fan housing 41 connected with the double air intake communicator 3 and communicated with a first air inlet 7, and a fan body 42 connected with the fan housing 41, and a first wind inlet 9 is provided at one end of the fan housing 41.

Using the above-mentioned technical scheme, when using the gas supply fan device 4, the fan body 42 is turned on, and the gas enters the fan housing 41 from the first wind inlet 9, and then enters the double air intake communicator 3 through the first air inlet 7 of the double air intake communicator 3 and outputs a high-flow gas.

In the embodiment, the air supply fan device 4 further comprises a filter screen 43 connected with the inner wall of the first wind inlet 9 in the fan housing 41.

Using the above-mentioned technical scheme, gas enters the fan housing 41 from the first wind inlet 9, and is filtered by the filter screen 43, so that the large particle matter can be filtered and prevented from entering the fan housing 41, otherwise will cause blockage or affect air supply.

In the embodiment, a top of the fan housing 41 is provided with a first accommodating groove 10 for accommodating the first one-way valve 1, and a first wind outlet 11 is provided in a bottom wall of the first accommodating groove 10.

Using the technical scheme, the first one-way valve 1 only allows gas to enter the first air inlet 7 from the first wind outlet 11, and the gas of the first air inlet 7 is prevented from flowing back to the first wind outlet 11, so as to improve the air filling efficiency. The first one-way valve 1 is accommodated in the first accommodating groove 10, so that the first one-way valve 1 can play its role in the first accommodating groove 10.

In the embodiments of FIG. 1-2 and FIG. 4-7, the air supply piston device 5 comprises a cylinder-integrated bracket 51 connected with the double air intake communicator 3 and communicated with the second air inlet 8, a motor 52 connected with the bottom of the cylinder-integrated bracket 51, a heat dissipation fan 53 in transmission connection with the first output end of the motor 52, a gear transmission mechanism 54 in transmission connection with other output end of the motor 52, and a connecting rod piston 55 in transmission connection with the gear transmission mechanism 54, a piston end of the connecting rod piston 55 is slidably connected with an inner wall of the cylinder end of the cylinder-integrated bracket 51, and the piston end of the connecting rod piston 55 is provided with a second wind inlet 12.

Using the above-mentioned technical scheme, when using air supply piston device 5, the motor 52 is turned on, and one output end of the motor 52 drives the heat dissipation fan 53 to rotate and dissipate heat, preventing the air supply piston device 5 from overheating. The other output end of the motor 52 drives the gear transmission mechanism 54, then drives the connecting rod piston 55 to reciprocate at the cylinder end of the cylinder-integrated bracket 51, and gas enters into the cylinder-integrated bracket 51 from the second wind inlet 12, then enters the double air intake communicator 3 through the second air inlet 8 to output high-pressure gas. Further, one side of the connecting rod piston 55 close to the double air intake communicator 3 is connected with a third one-way valve (not shown in the figures) for air intake of the second wind inlet 12, so as to avoid the gas from venting along the second wind inlet 12 when pumping.

Figure 6:
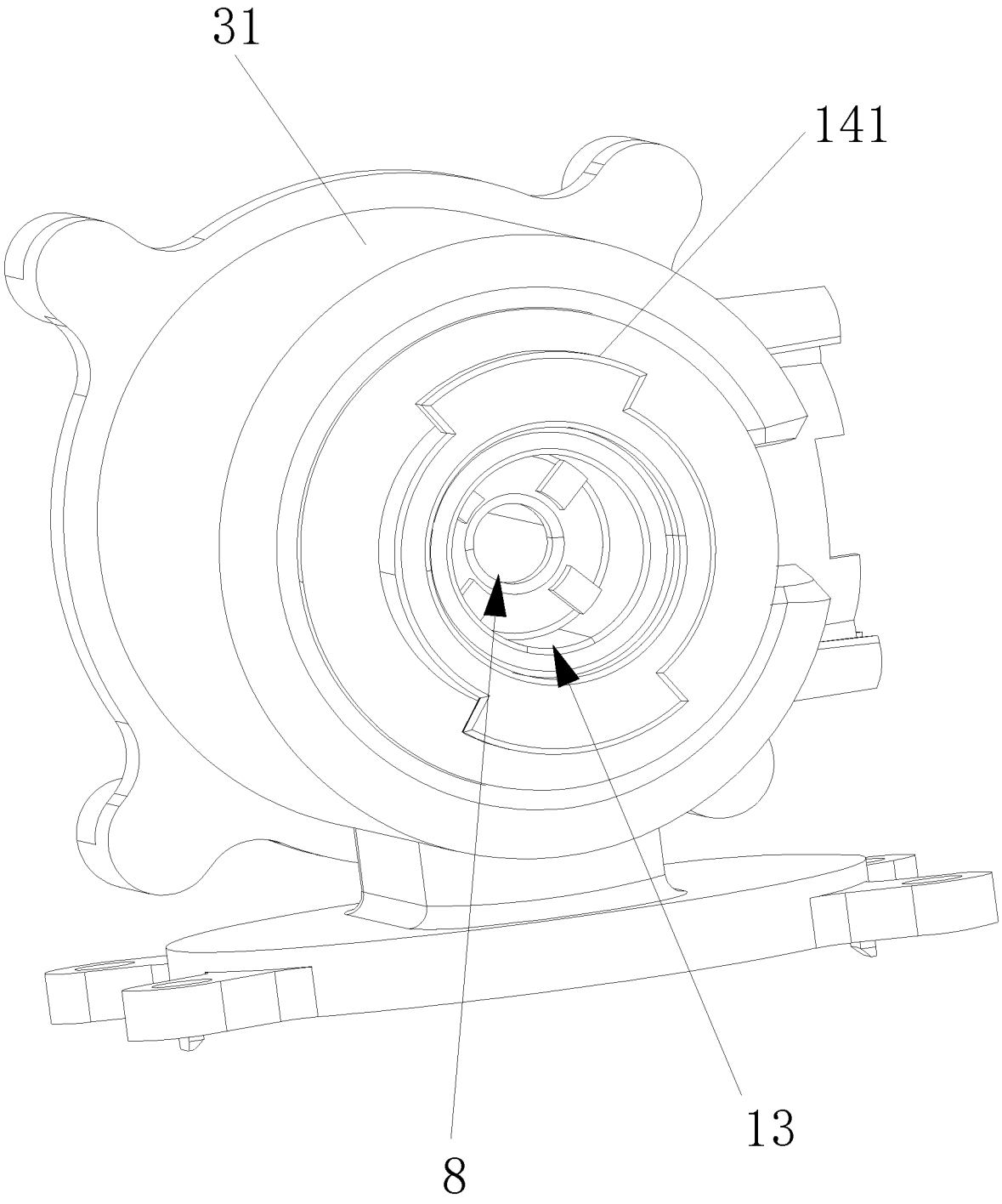
FIG. 6 is a schematic diagram of the structure of the double air intake communicator of the present disclosure.
Figure 7:
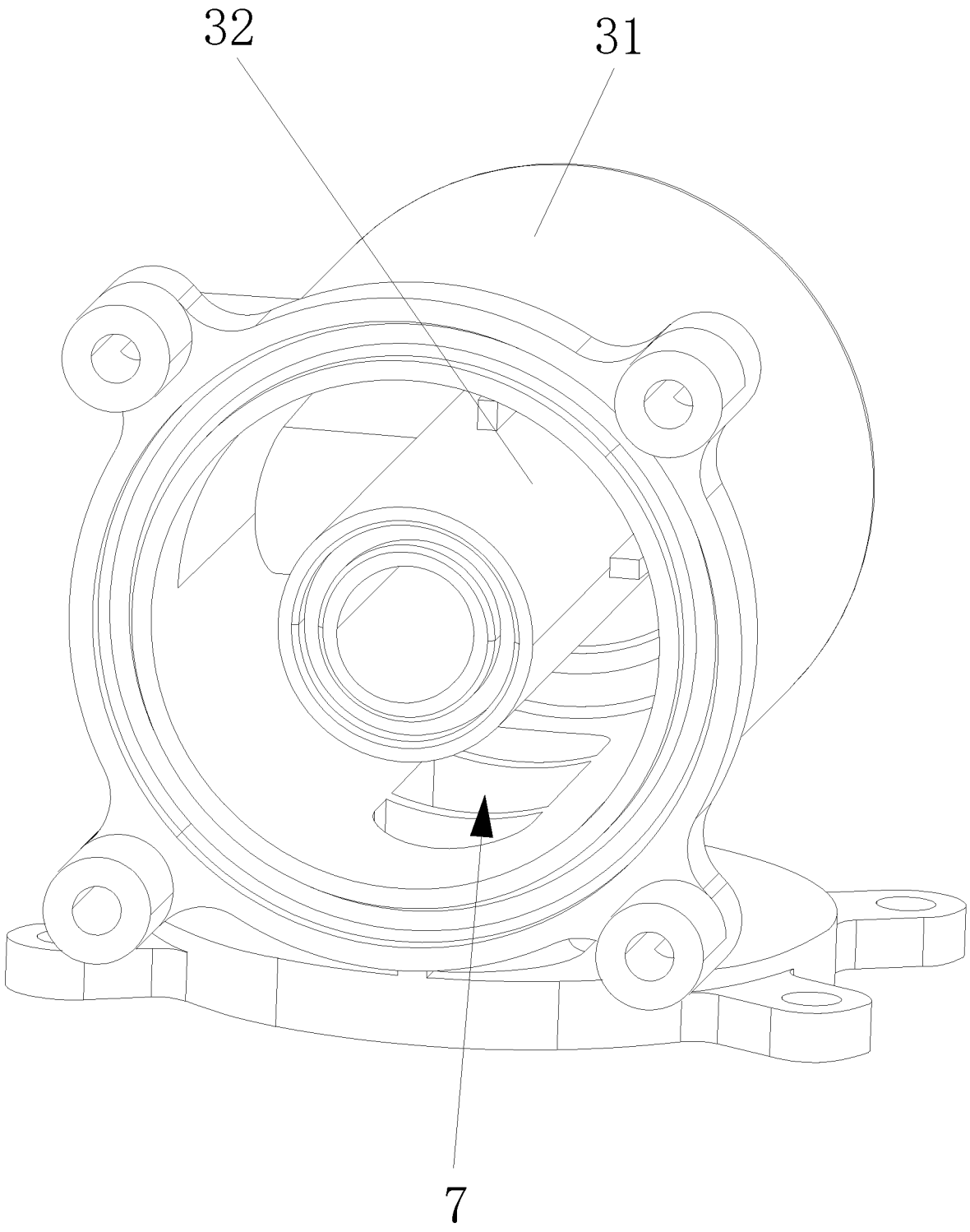
FIG. 7 is a schematic diagram of the structure of the double air intake communicator of the present disclosure in another view.
Figure 8:
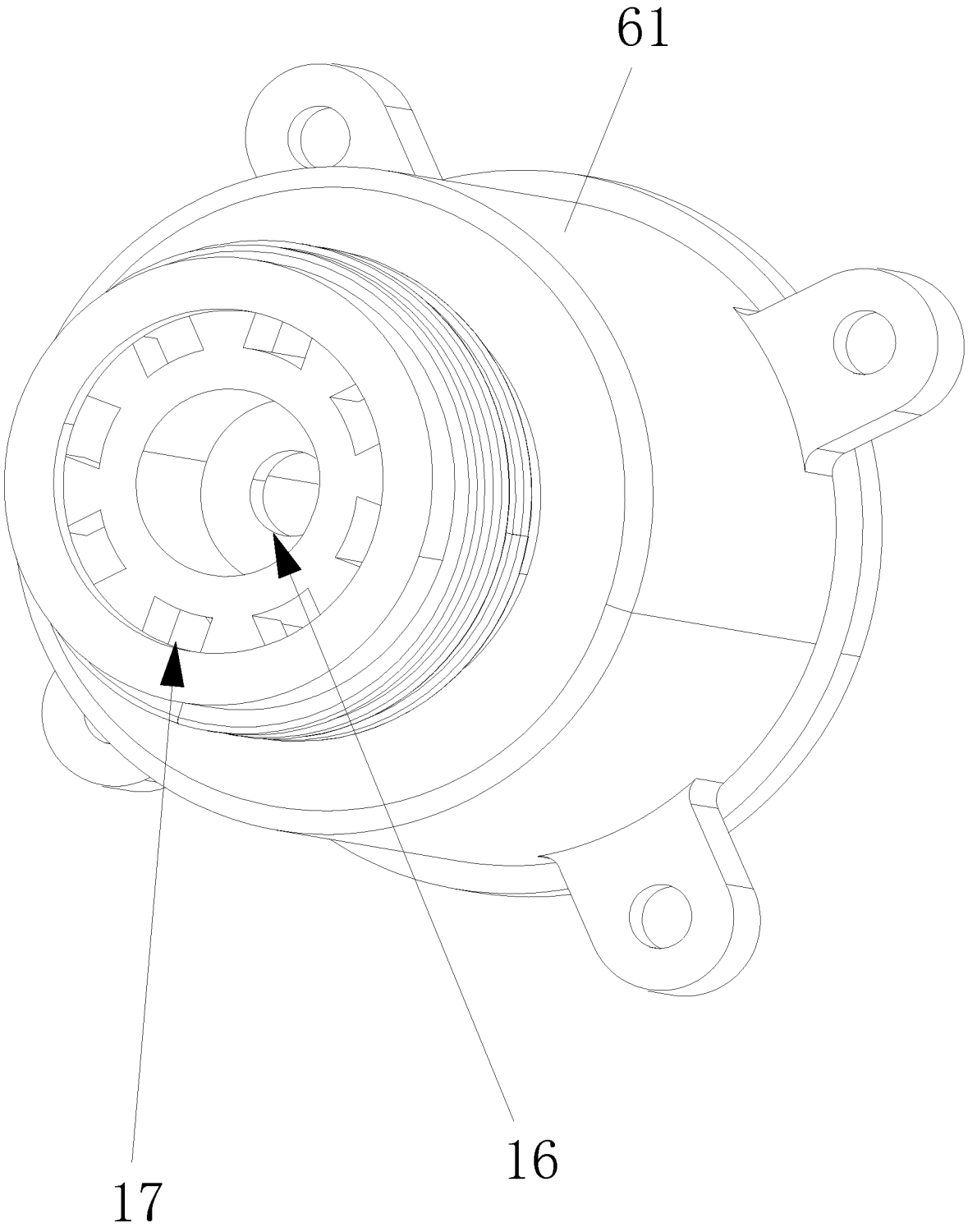
FIG. 8 is a schematic diagram of the structure of the inflatable joint of the present disclosure in another view.
Figure 9:
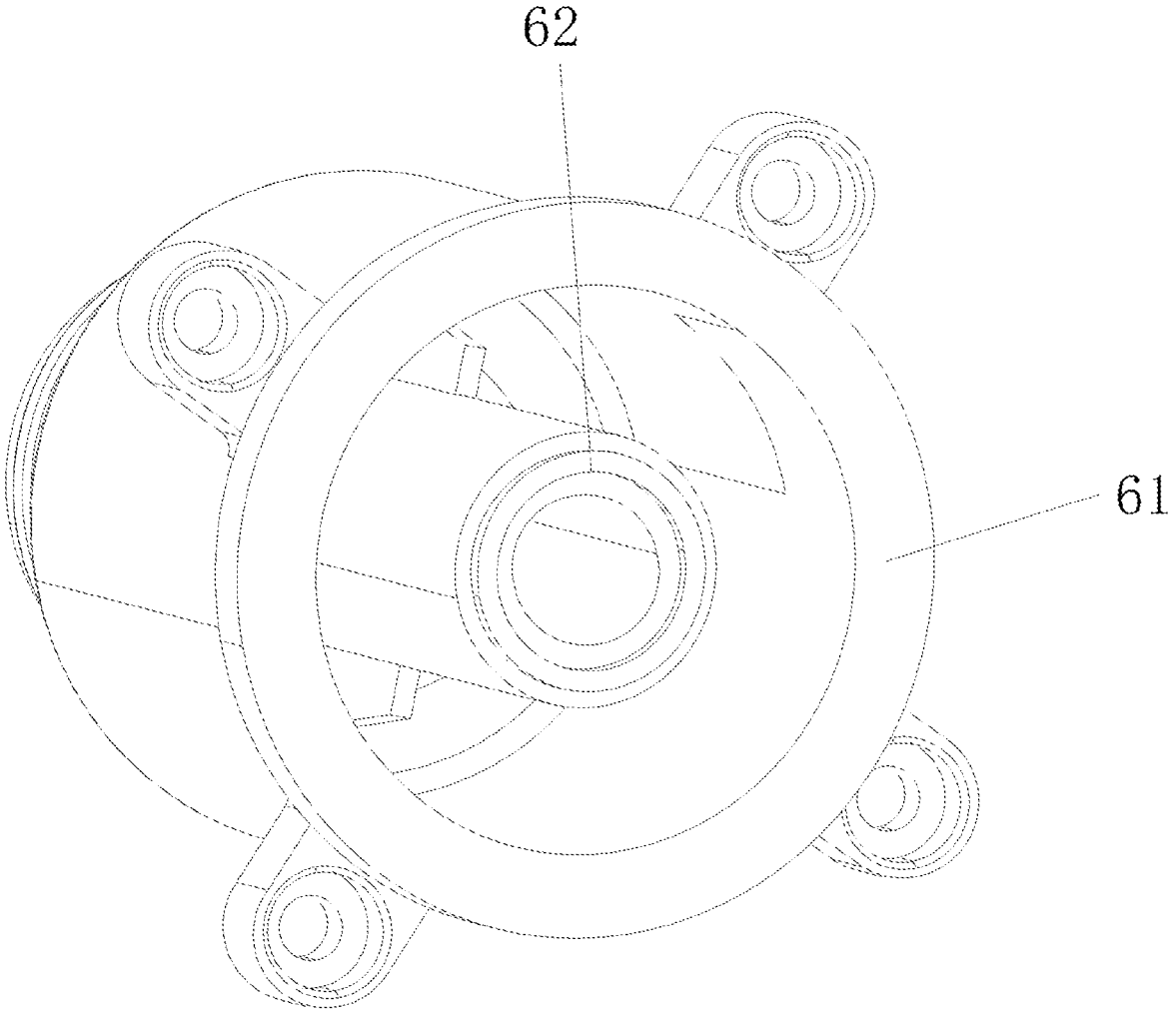
FIG. 9 is a schematic diagram of the structure of the inflatable joint of the present disclosure.

In the embodiment of FIG. 6, one end of the double air intake communicator 3 connected with the cylinder-integrated bracket 51 is recessed with a second accommodating groove 13 for accommodating the second one-way valve 2, and the second air inlet 8 is provided at the bottom wall of the second accommodating groove 13.

Using the above-mentioned technical scheme, the second one-way valve 2 only allows the gas of the second wind inlet 12 to enter the second air inlet 8 through the cylinder-integrated bracket 51, and the gas of the second air inlet 8 is prevented from flowing back to the cylinder-integrated bracket 51, so as to improve the effectiveness of inflation. The second accommodating groove 13 accommodates a second one-way valve 2, so that the second one-way valve 2 can play its role in the second accommodating groove 13.

Figure 4:
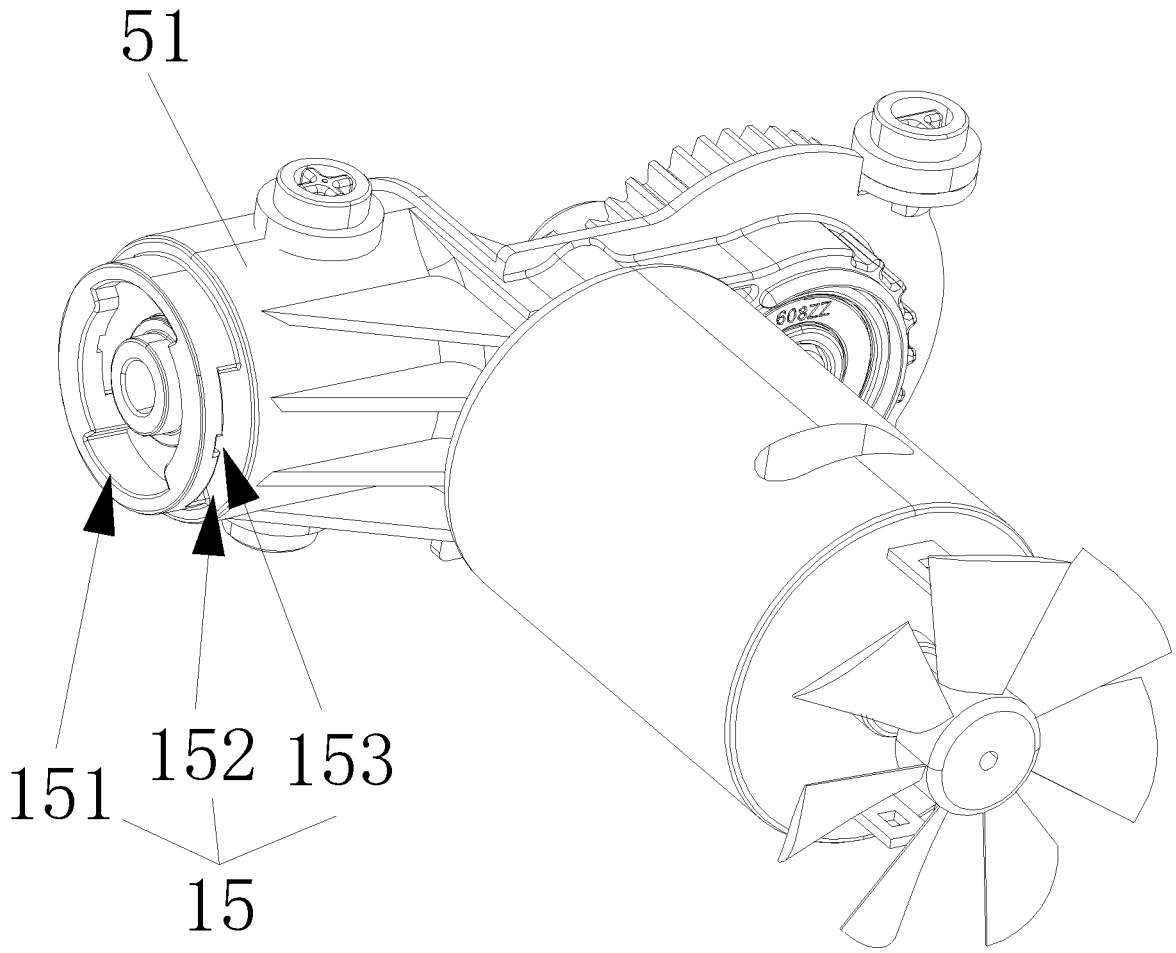
FIG. 4 is a structural schematic diagram of the air supply piston device of the present disclosure.
Figure 5:
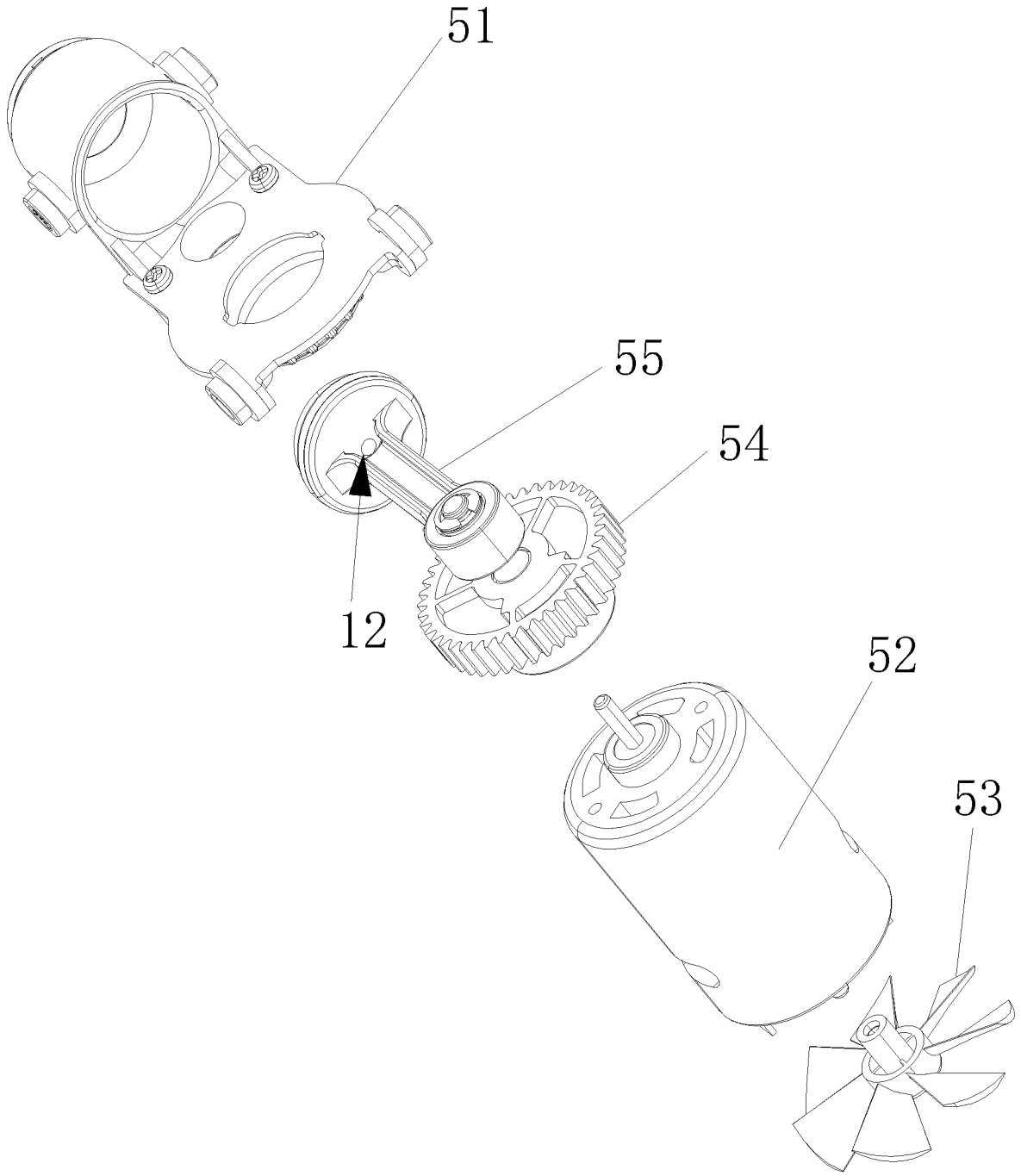
FIG. 5 is a schematic diagram of an exploded structure of the air supply piston device of the present disclosure.

In the embodiment of FIG. 3, FIG. 4 and FIG. 6, the side wall of the double air intake communicator 3 is protruded with a rotating buckle 14, and one end of the cylinder-integrated bracket 51 and the double air intake communicator 3 is provided with a rotating clamping groove 15 for clamping the rotating buckle 14.

Using the above-mentioned technical scheme, when assembling, the rotating buckle 14 is rotatingly clamped to the rotating groove 15, the cylinder-integrated bracket 51 and the double air intake communicator 3 can be fixedly assembled together, with a high installation efficiency, and the cylinder-integrated bracket 51 itself is integrated, saving the assembly efficiency.

In the embodiment, the rotating buckle 14 comprises a rotating bump 141 protruding on the side wall of the double air intake communicator 3, a convex ridge 142 protruded on the rotating bump 141, the rotating clamping groove 15 comprises a relinquishing groove 151, a notch 152 communicated with the relinquishing groove 151, and a buckle groove 153 provided on the cylinder-integrated bracket 51 and communicated with a top of the notch 152, and the relinquishing groove 151 is used for the rotating bump 141 to stretch and screw into the notch 152, and the convex ridge 142 is clamped with the buckle groove 153.

Using the above-mentioned technical scheme, the cylinder-integrated bracket 51 can be assembled together with the double air intake communicator 3 by screwing the rotating bump 141 into the notch 152 through the relinquishing groove 151, and clamping the convex ridge 142 with the buckle groove 153, with high installation efficiency.

In the embodiment of FIG. 6-9, the double air intake communicator 3 comprises a first casing 31, a first inner pipe 32 connected in the first casing 31 and penetrates through the first casing 31 close to one end of the air supply piston device 5, the first air inlet 7 is provided at the bottom of the first casing 31, and the second air inlet 8 is provided in one end of the first inner pipe 32 close to the air supply piston device 5.

Further, the inflatable joint 6 comprises a second casing 61 communicated with the first casing 31, a second inner pipe 62 connected in the second casing 61 and penetrates through the second casing 61 far away from one end of the first casing 31, one end of the second casing 61 away from the first casing 31 is provided with a high-flow exhaust hole 16, one end of the second inner pipe 62 away from the first inner pipe 32 is provided with a high-pressure exhaust hole 17, and the air supply fan device 4, the first casing 31, the second casing 61 is communicated with the high-flow exhaust hole 16 to form a first channel for transporting the high-flow gas, and the air supply piston device 5, the first inner pipe 32, the second inner pipe 62 and the high-pressure exhaust hole 17 are communicated to form a second channel for transporting a high-pressure gas.

Using the above-mentioned technical scheme, gas supply fan device 4, the first casing 31, the second casing 61 and high-flow exhaust hole 16 are communicated to form the first channel for transporting high-flow gas, and air supply piston device 5, the first inner pipe 32, the second inner pipe 62 and high-pressure exhaust hole 17 are communicated to form the second channel for transporting the high-pressure gas, so that the inflatable joint 6 is connected with different gas pipes.

In another embodiment, the inflatable movement is located in a housing made of lightweight material. The housing is a closed housing with an opening at one end, and the inflatable pipe connected with the opening by the inflatable joint extends out from the inside of the housing in the direction away from the housing. The casing also has a display screen showing the working state of the inflatable movement. The present disclosure uses the compact design of the inflatable movement, housing with a lightweight material, energy-saving technology, automatic control system, and intelligent sensors, etc. to improve the performance of the multi-functional inflatable pump, and improve the intelligent level and automation of the inflatable pump. Through the advanced air pump technology and optimized design, the introduction of advanced control algorithms and sensor technologies, the emergency tire-repaired inflator pump has the functions of digital display; automatic charging and stopping/pressure regulation, etc., with an inflation capacity of 40-50 L/min. The technology is stable for use from −30° ° C. to 70° C., which realizes precise pressure control and a stable inflation process, improving the accuracy and safety of inflation.

The high-pressure, high-flow inflatable movement of the present disclosure adopts a double air intake communicator communicated with the air supply fan device and the air supply piston device, the air supply fan device is used for outputting a high-flow gas to the double air intake communicator, and the air supply piston device is used for outputting a high-pressure gas to the double air intake communicator. Using the first one-way valve and the second one-way valve, wind interference is prevented. If the inflatable product has a low air pressure, the air supply fan device is turned on to output a high-flow gas to the double air intake communicator, and fill a large flow of gas, with an improved gas filling efficiency, and when the inflatable product has a high air pressure and the air filling capacity of the air supply fan device is significantly reduced, the air supply fan device is turned off, and the air supply piston device is turned on to output the high-pressure gas to the double air intake communicator, until the expected high pressure is reached, significantly reducing the inflation time, preventing the overheating and damage of the inflatable movement operation.

The above embodiment is a better embodiment of the present disclosure, and in addition, the present disclosure can be realized in other ways, and any obvious replacement is within the scope of protection of the present disclosure without departing from the conception of the present disclosure.

What is claimed is:

1. An inflatable pump, comprising a double air intake communicator, an air supply fan device communicated with a first air inlet of the double air intake communicator, an air supply piston device communicated with a second air inlet of the double air intake communicator, a first one-way valve communicated with the double air intake communicator and the air supply fan device, a second one-way valve communicated with the double air intake communicator and the air supply piston device, and an inflatable joint communicated with an air outlet of the double air intake communicator, the air supply fan device used for outputting a high-flow gas to the double air intake communicator, and the air supply piston device is used for outputting a high-pressure gas to the double air intake communicator, wherein the double air intake communicator comprises a first casing, and a first inner pipe connected in the first casing and penetrates through the first casing close to one end of the air supply piston device, the first air inlet is provided at the bottom of the first casing, and the second air inlet is provided in one end of the first inner pipe close to the air supply piston device.

2. The inflatable pump of claim 1, wherein the air supply fan device comprises a fan housing connected with the double air intake communicator and communicated with the first air inlet, and a fan body communicated with the fan housing, and one end of the fan housing is provided with a first wind inlet.

3. The inflatable pump of claim 2, wherein the air supply fan device further comprises a filter screen connected with an inner wall of the first wind inlet in the fan housing.

4. The inflatable pump of claim 2, wherein a top of the fan housing is provided with a first accommodating groove for accommodating the first one-way valve, and a bottom wall of the first accommodating groove is provided with a first wind outlet.

5. The inflatable pump of claim 1, wherein the air supply piston device comprises a cylinder-integrated bracket connected with the double air intake communicator and communicated with the second air inlet, a motor connected with a bottom of the cylinder-integrated bracket, a heat dissipation fan in transmission connection with an output end of the motor, a gear transmission mechanism in transmission connection with other output end of the motor, and a connecting rod piston in transmission connection with the gear transmission mechanism, a piston end of the connecting rod piston is slidably connected with an inner wall of a cylinder end of the cylinder-integrated bracket, and the piston end of the connecting rod piston is provided with a second wind inlet.

6. The inflatable pump of claim 5, wherein one end of the double air intake communicator connected with the cylinder-integrated bracket is recessed with a second accommodating groove for accommodating the second one-way valve, and the second air inlet is provided at the bottom wall of the second accommodating groove.

7. The inflatable pump of claim 5, wherein a side wall of the double air intake communicator is protruded with a rotating buckle, and one end of the cylinder-integrated bracket connected with the double air intake communicator is provided with a rotating clamping groove used for clamping with the rotating buckle.

8. The inflatable pump of claim 7, wherein the rotating buckle comprises a rotating bump protruded on the side wall of the double air intake communicator, and a convex ridge protruded on the rotating bump, the rotating clamping groove comprises a relinquishing groove, a notch communicated with the relinquishing groove, and a buckle groove provided on the cylinder-integrated bracket and communicated with a top of the notch, and the relinquishing groove is used for the rotating bump to stretch and screw into the notch, and the convex ridge is clamped with the buckle groove.

9. The inflatable pump of claim 1, wherein the inflatable joint comprises a second casing communicated with the first casing, a second inner pipe connected in the second casing and penetrates through the second casing far away from one end of the first casing, one end of the second casing away from the first casing is provided with a high-flow exhaust hole, one end of the second inner pipe away from the first inner pipe is provided with a high-pressure exhaust hole, the air supply fan device, the first casing, the second casing and the high-flow exhaust hole are communicated to form a first channel for transporting the high-flow gas, and the air supply piston device, the first inner pipe, the second inner pipe and the high-pressure exhaust hole are communicated to form a second channel for transporting the high-pressure gas.

* * * * *